US008876436B2

(12) United States Patent
Steyn

(10) Patent No.: US 8,876,436 B2
(45) Date of Patent: Nov. 4, 2014

(54) ROCK BOLT

(71) Applicant: Johann Steyn, Germiston (ZA)

(72) Inventor: Johann Steyn, Germiston (ZA)

(73) Assignee: RSC Mining (Pty) Ltd., Germiston (ZA)

( * ) Notice: Subject to any disclaimer, the term of this patent is extended or adjusted under 35 U.S.C. 154(b) by 77 days.

(21) Appl. No.: 13/706,697

(22) Filed: Dec. 6, 2012

(65) Prior Publication Data

US 2013/0156510 A1 Jun. 20, 2013

(30) Foreign Application Priority Data

Dec. 14, 2011 (ZA) ..... 2011/09192

(51) Int. Cl.
*E21D 21/00* (2006.01)
*E21D 20/02* (2006.01)

(52) U.S. Cl.
CPC ..... *E21D 21/0093* (2013.01); *E21D 20/026* (2013.01); *E21D 21/0026* (2013.01); *E21D 21/0033* (2013.01)
USPC ..... 405/259.1; 405/259.3; 405/259.5

(58) Field of Classification Search
USPC ..... 405/259.1, 259.3, 259.5, 259.6
See application file for complete search history.

(56) References Cited

U.S. PATENT DOCUMENTS

| | | | | | |
|---|---|---|---|---|---|
| 3,797,254 | A * | 3/1974 | Askey et al. | ..... | 405/259.3 |
| 4,400,113 | A * | 8/1983 | Chaiko et al. | ..... | 405/259.6 |
| 4,407,610 | A * | 10/1983 | Elders | ..... | 405/259.3 |
| 4,461,600 | A * | 7/1984 | Norkus et al. | ..... | 405/259.5 |
| 4,696,606 | A * | 9/1987 | Herron | ..... | 405/259.3 |
| 4,952,096 | A * | 8/1990 | McCartney | ..... | 405/259.3 |
| 4,954,017 | A * | 9/1990 | Davis et al. | ..... | 405/259.3 |
| 6,935,811 | B2 * | 8/2005 | Simmons et al. | ..... | 405/259.3 |
| 7,367,751 | B2 * | 5/2008 | Vosbikian | ..... | 405/259.3 |
| 7,381,013 | B1 * | 6/2008 | Rataj et al. | ..... | 405/259.5 |
| 8,152,416 | B2 * | 4/2012 | Bureau | ..... | 405/259.3 |
| 2004/0161316 | A1 * | 8/2004 | Locotos et al. | ..... | 405/259.1 |
| 2008/0075539 | A1 * | 3/2008 | Vosbikian | ..... | 405/259.3 |
| 2011/0299939 | A1 * | 12/2011 | Craven et al. | ..... | 405/259.3 |
| 2011/0311315 | A1 * | 12/2011 | Evans et al. | ..... | 405/259.3 |

FOREIGN PATENT DOCUMENTS

| | | | | | |
|---|---|---|---|---|---|
| JP | 58007024 | A * | 1/1983 | ..... | E02D 5/80 |
| WO | WO 9004085 | A1 * | 4/1990 | ..... | E21D 20/00 |

* cited by examiner

*Primary Examiner* — Frederick L Lagman
(74) *Attorney, Agent, or Firm* — Mattingly & Malur, PC

(57) ABSTRACT

A rock bolt includes an elongate tubular body with an internal bore. A filler material is insertable into the internal bore at one end of the elongated tubular body. The end of the tubular body is then deformed thereby using the filler material to seal the end of the bore. The filler material may be a non-metallic material, such as a tube of plastic.

2 Claims, 1 Drawing Sheet

ROCK BOLT

CROSS-REFERENCE TO RELATED APPLICATIONS

This application corresponds to, and claims priority from South African Application No. 2011/09192, filed Dec. 14, 2011, the disclosure of which is expressly incorporated herein in its entirety by reference.

FIELD OF THE INVENTION

This invention relates to a rock bolt.

BACKGROUND OF THE INVENTION

Various support techniques are used in underground mining. In hard rock mining in South African gold mines, for example, a large diameter hole is drilled into a rock body whereafter a rock bolt is inserted into the hole. Full column grouting of the rock bolt is preferred to obtain superior performance. To achieve this objective without excessive use of steel, a tubular steel rock bolt is used. Typically, the tubular steel rock bolt is inserted into a borehole and is fixed in place using a grout or a resin mixture.

Normally, a capsule which contains resin components is placed in a borehole. The capsule is punctured when the rock bolt is inserted into the hole and the contents of the capsule are mixed by rotating the rock bolt. If the rock bolt is tubular, a leading end of the rock bolt must be closed to prevent the resin mix from flowing into an interior of the rock bolt. One way of sealing the tubular rock bolt is to deform the leading end, so that it is pointed. However, when this point penetrates the capsule, a so-called "finger gloving" effect may arise, when the bolt is rotated, which effect results in the resin not being adequately mixed or correctly distributed throughout the borehole.

If the leading end of the rock bolt is pressed flat and is thus closed, a chisel shape results. This helps to avoid "finger gloving" during resin mixing. However, the leading end will have a width which exceeds the width of a borehole—a feature which works against the adoption of this technique.

An object of the present invention is to provide a rock bolt which enables the aforementioned situation to be addressed.

SUMMARY OF INVENTION

The present invention provides a rock bolt which includes an elongate tubular body with an internal bore, a leading end and a trailing end, and with a filler material in the leading end. The leading end of the elongate tubular body is deformed so that the filler material seals the bore at the leading end.

The filler material may be of any appropriate kind. In one example of the invention, the filler material is non-metallic e.g. of a plastics material. The filler material may, initially, have any suitable shape and in one form of the invention the filler material initially is tubular.

Preferably, the filler material is initially a tube of a plastics material which can fit closely into the bore at the leading end of the elongate tubular body prior to deformation thereof.

When the leading end of the elongate tubular body is deformed, this is preferably done in a way which does not meaningfully increase the width of the leading end. Additionally, an objective in this respect, is to ensure that the filler material acts to seal gaps between opposing surfaces of the rock bolt at the leading end of the elongate tubular body.

The leading end may be deformed so that, in cross-section, it is generally of a U-shape.

BRIEF DESCRIPTION OF THE DRAWINGS

The invention is further described by way of example with reference to the accompanying drawings in which.

DESCRIPTION OF PREFERRED EMBODIMENT

Figure 1:
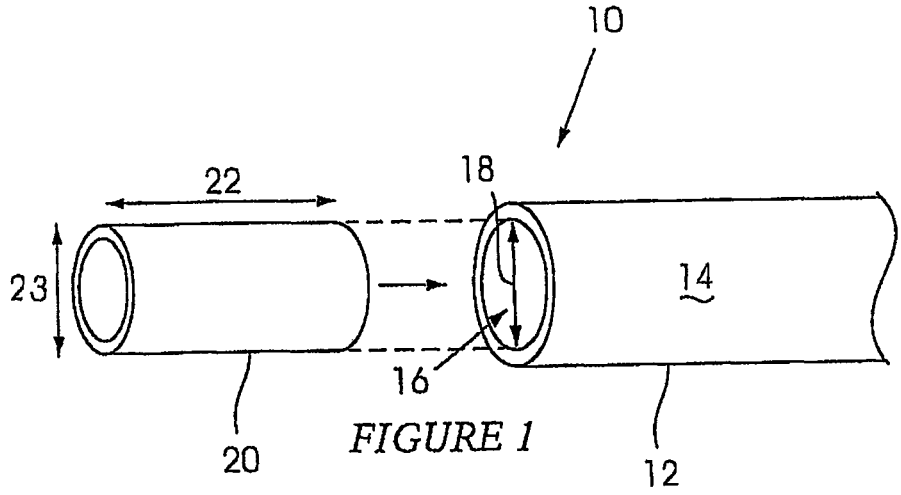
FIG. 1 shows a leading end of a tubular rock bolt and a length of filler material.
Figure 2:
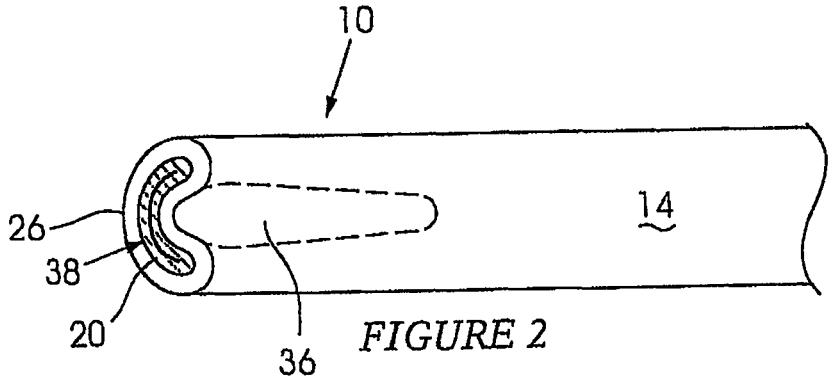
FIG. 2 illustrates how the leading end is deformed to achieve a sealing action.

FIG. 1 of the accompanying drawings illustrates, in perspective, a leading end 10 of a tubular rock bolt 12. A trailing end of the tubular rock bolt 12 is not shown.

The tubular rock bolt 12 is made from a suitable metal and has external keying formations, not shown, on an outer surface 14.

The tubular rock bolt 12 has an inner bore 16 with an internal diameter 18.

In order to seal the leading end 10 of the tubular rock bolt 12, use is made of a short, hollow tube 20 of a plastics material such as high density polyethylene (HDPE). The tube 20 has a length 22 and an external diameter 23 which external diameter 23 is substantially the same as the internal diameter 18 of the inner bore 16. The tube 20 can thus be inserted with a relatively tight fit into the inner bore 16 at the leading end 10 of the tubular rock bolt 12.

Figure 3:
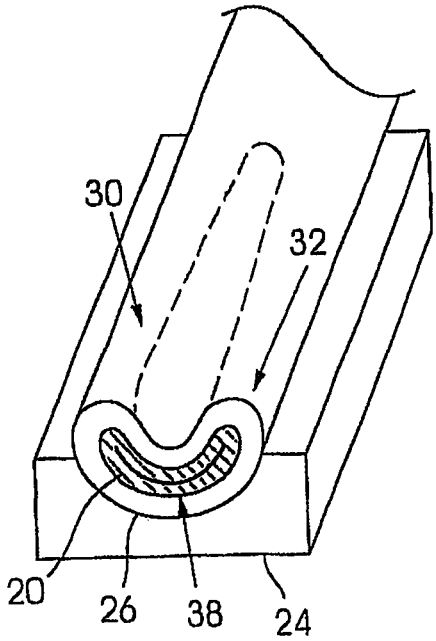
FIG. 3 illustrates an aspect of a possible manufacturing step.

In a subsequent manufacturing step, the leading end 10 of the tubular rock bolt 12, with the tube 20 engaged therewith, is inserted into a suitable press, as shown in FIG. 3, by way of example only. The press has a bed 24 which cradles a first half section 26 of the leading end 10. A tool, which is not specifically shown, and which has a narrow elongate shape and a length which is of the order of the length 22 of the tube 20, is then pressed onto an outer surface 30 of a diametrically opposing second half section 32 of the leading end 10 of the tubular rock bolt 12 which is thus formed into the half section 26. In this way, an elongate U-shaped recess or channel 36 is formed in the half section 32 and extends radially towards the half section 26. The tube 20 is readily deformed in this process and fills a space 38 between opposing surfaces of the half section 26 and the now deformed section 32. The plastic material is in tight sealing engagement with these opposed surfaces and a sound seal results. Additionally, the transverse dimension of the sealed leading end is not meaningfully increased relative to the external diameter of the rock bolt shank.

It has been found that if an attempt is made to seal the leading end 10 of the rock bolt 12 without using a filler material, that the material of the rock bolt 12 is liable to fracture or split due to the excessive amount of metal working which is required. When the filler material 20 is used, the leading end 10 of the tubular rock bolt 12 is sealed and the integrity of the leading end 10 is maintained i.e. there is no cracking or splitting of the metal. The filler 20 is, conveniently, initially of tubular shape but this is exemplary only, and non-limiting. Additionally, the leading end 10 of the tubular rock bolt is shaped so that when it is used for penetrating and then mixing a resin capsule there is no "finger gloving" effect.

What is claimed is:

1. A rock bolt comprising:

an elongate tubular body having an internal bore, a leading end and a trailing end; and filler material in the internal bore at the leading end of the elongate tubular body, wherein the filler material is initially a tube of a plastics material which can fit closely into the internal bore at the leading end of the elongate tubular body and further wherein, when the leading end of the elongate tubular body is deformed, the filler material seals the internal bore of the elongate tubular body at the leading end thereof.

2. A rock bolt comprising:

an elongate tubular body having an internal bore, a leading end and a trailing end; and filler material in the internal bore at the leading end of the elongate tubular body, wherein the leading end of the elongate tubular body is deformed so that at the leading end a first half section of the leading end of the elongate tubular body is forced into a diametrically opposed second half section of the elongate tubular body, and the filler material fills a space between opposing surfaces of the first and second half sections and seals the internal bore of the elongate tubular body at the leading end thereof.

* * * * *